US006705190B2

(12) United States Patent
Newnes et al.

(10) Patent No.: US 6,705,190 B2
(45) Date of Patent: Mar. 16, 2004

(54) LUMBER TRIMMER

(75) Inventors: William R. Newnes, Salmon Arm (CA); Deane R. Henderson, Salmon Arm (CA); Paul L. Halper, Salmon Arm (CA)

(73) Assignee: Coe Newnes McGehee ULC, Halifax (CA)

( * ) Notice: Subject to any disclaimer, the term of this patent is extended or adjusted under 35 U.S.C. 154(b) by 133 days.

(21) Appl. No.: 09/965,020

(22) Filed: Sep. 26, 2001

(65) Prior Publication Data

US 2002/0038588 A1 Apr. 4, 2002

Related U.S. Application Data

(63) Continuation-in-part of application No. 09/912,630, filed on Jul. 24, 2001.

(60) Provisional application No. 60/220,176, filed on Jul. 24, 2000.

(51) Int. Cl.[7] ..... B26D 5/00

(52) U.S. Cl. ..... 83/75.5; 83/370; 83/425.2; 144/357

(58) Field of Search ..... 83/75.5, 425.4, 83/425.2, 425.3, 404, 368, 370, 371, 425.5, 435.2, 508.1, 372, 732, 76.8, 367, 422, 100; 474/101; 144/357, 133.1, 245.2, 245.1, 246.1

(56) References Cited

U.S. PATENT DOCUMENTS

| | | | | | |
|---|---|---|---|---|---|
| 2,332,654 | A | | 10/1943 | Mead et al. | |
| 2,403,673 | A | | 7/1946 | Mead | |
| 2,641,288 | A | | 6/1953 | Blickenderfer et al. | |
| 3,036,605 | A | | 5/1962 | Joa | |
| 3,063,479 | A | | 11/1962 | Prentice | |
| 4,031,790 | A | * | 6/1977 | Arvidsson | 83/425.4 |
| 4,093,007 | A | * | 6/1978 | Hellstrom | 144/356 |
| 4,599,929 | A | * | 7/1986 | Dutina | 83/821 |
| 4,960,023 | A | * | 10/1990 | Reuter et al. | 83/368 |
| 5,094,654 | A | | 3/1992 | Strom | |
| 5,142,955 | A | * | 9/1992 | Hale | 83/75.5 |
| 5,143,127 | A | * | 9/1992 | Rautio | 144/39 |
| 5,205,705 | A | * | 4/1993 | Jenkner | 414/796.8 |
| 5,680,888 | A | * | 10/1997 | St-Pierre et al. | 144/357 |
| 5,816,302 | A | * | 10/1998 | Newnes | 144/357 |
| 5,927,174 | A | * | 7/1999 | Newnes et al. | 83/827 |
| 6,173,829 | B1 | * | 1/2001 | Jackson et al. | 198/456 |

* cited by examiner

*Primary Examiner*—Allan N. Shoap
*Assistant Examiner*—Ghassen Alie
(74) *Attorney, Agent, or Firm*—Antony G. Edwards

(57) ABSTRACT

A lumber trimming device for trimming elongate workpieces conveyed on an infeed conveyor in a laterally disposed orientation relative to an infeed direction. The lumber trimming device includes a gang of laterally spaced apart drop saws wherein the drop saws are independently actuable according to generally optimized trimming instructions from an optimizer. At least on end-trimming saw is mounted adjacent the gang. The end-trimming saw or saws is or are selectively laterally translatable according to optimized end-trimming instructions from the optimizer so as to cooperate with the gang. The end-trimming saw or saws cooperate with the optimizer and the drop saws so that a first drop saw of the drop saws is actuated simultaneously with optimized lateral positioning of a first end-trimming saw so as to trim a first workpiece of the workpieces on the infeed conveyor simultaneously by both the first drop saw in a first trim cut and the first end-trimming saw in a second trim cut. Where a second end-trimming saw is employed, the first end-trimming saw cooperates with the optimizer to laterally re-position the first end-trimming saw subsequent to the second trim cut simultaneously with the second end-trimming saw actively laterally pre-positioning for an end trim cut on a second and next-adjacent workpiece on the infeed conveyor.

17 Claims, 11 Drawing Sheets

14
158
144
144
144

114
114
114

LUMBER TRIMMER

CROSS REFERENCE TO RELATED APPLICATION

This application is a Continuation-in-Part of U.S. patent application Ser. No. 09/912,630 filed Jul. 24, 2001 entitled Board Trimmer with Pre-Trimmer Near-Ends Saws, which claims domestic priority from U.S. Provisional Patent Application No. 60/220,176 filed Jul. 24, 2000.

FIELD OF THE INVENTION

This invention relates to the field of trimmers and in particular to an improved lumber trimmer which may include P.E.T. saws.

BACKGROUND OF THE INVENTION

As well-documented in the prior art, there is continual development in devices for optimizing lumber production. Typically the optimization of lumber production is accomplished by either increasing the yield rate or the piece rate, or both. That is, optimization of lumber production is accomplished by maximizing the amount of useable lumber obtained from a single raw workpiece such as a log, and this is often optimized to maximize the amount of useable lumber having the highest resale value. As an example of optimising the piece rate, it is desirable to increase the production rate for example by increasing the efficiency of lumber production, often reflected in the maximum maintainable transfer speed expressed in for example feet per minute, lugs per minute or boards per minute. In optimizing the yield rate, speed and accuracy in implementing the optimized cutting solution is important if not paramount.

In the specific instance of a trimming saw or trimmer having multiple saws, where the accuracy of cut may be desirably measured in the tens of thousandths of an inch to optimize the yield rate, and where the piece rates are high for example on infeed conveyors up to 200 lugs per minute, prior art ending of lumber pieces against a fence for example by the use of ending rolls or angled in-line wheels often result in unacceptable inaccuracy due to bounce-back, tip-crush or the like.

In the prior art applicant is aware of U.S. Pat. No. 5,142,955 which issued Sep. 1, 1992 to Hale for a Lumber Cutter for Removing End Defects and Sawing to Desired Lengths. Hale discloses a root end trim saw extending over the root end edge of a lumber piece conveyor. The saw blade is articulated to move down into or up out of the path of lumber pieces and is slidably mounted to be moved over a two-foot range in one-half inch increments to cut away a defective end portion of a lumber piece. The root end trim saw pre-trims a lumber piece which is then ended against a fence prior to entering a trimmer. In use such a saw suffers from at least two drawbacks, namely, that following pre-trimming by the saw the lumber is then ended against a fence reintroducing inaccuracy in positioning of the lumber piece as it enters the trimmer, and, secondly, that at high piece rates the lateral positioning of the root end trim saw within the range specified will limit the transfer rate. The lumber pieces cannot arrive quicker than the time required for the saw to be moved into position for its next cut. As an example, in a worst case scenario, the saw must be translated across the length of its range between the arrival of adjacent lumber pieces. Thus, at high piece rates, it may be required that the conveyor be slowed down until the root end trim saw can be slid into position, thus adversely affecting the optimum piece rate. Consequently it will be appreciated that the design of Hale may adversely affect not only the accuracy of the yield, and thus the yield rate, but also the piece rate.

SUMMARY OF THE INVENTION

The optimizer controls obtaining the desired yield from a particular raw lumber piece. In order to do so, the optimizer controls the yield and piece rates. In applicant's experience, quite often the optimizer optimizes the cutting solution so as to obtain the most-valuable (i.e. highest yield rate) combination of sawn lumber pieces which may be sawn from the raw lumber piece. Where an end trimmer saw, for example the pre-trimmer root end saw of Hale or a so-called precision end trimmer ("P.E.T.") saw is employed, that is, an end trimming saw which is laterally translatable relative to the length of an incoming lumber piece, in a worst case scenario must translate for example 12 inches between adjacent arriving lumber pieces, the optimizer may reduce the infeed conveyor speed (i.e. reduce the piece rate) so as to not adversely affect the yield rate. That is, the optimizer adversely affects the piece rate in order to obtain the highest value yield rate. In applicant's view, an overall optimized solution in such an instance may be obtained, firstly, by the optimizer implementing for example a second, as opposed to first, most-valuable default cut where the second or lesser valuable default cuts do not, or have a lesser adverse effect on, the piece rate. It is applicant's view that in the trade-off between a first most-valuable cut and a second or lesser valuable default cut and the trade-off in reducing the piece rate in order to implement the most-valuable cut or maintaining a high piece rate while implementing a second or lesser valuable default cut, a globally optimized result is obtained by maintaining the maximum piece rate and accepting a second or lesser valuable default cut thereby slightly degrading the yield rate. Secondly, rather than merely relying on a single root end or P.E.T. trimming saw, a plurality of root end or P.E.T. saws may be employed.

Use of a plurality such as a pair of P.E.T. saws in conjunction with an active infeed board positioner such as, without intending to be limiting, a live fence or selectively actuable ending rolls or inclined in-line wheels (so called skate wheels), allow for adjacent lumber pieces on the infeed to be end-trimmed, if need be, as for example when two adjacent boards need P.E.T. sawing or a specific (e.g. metric) length is best suited, alternating between for example alternating P.E.T. saws in a pair of such saws. The pair of saws may be opposed facing or may be side-by-side, or may form a subset of a plurality of such saws. Thus, as needed, a first P.E.T. saw may be employed to end-trim a first lumber piece, and a second P.E.T. saw may be employed to end-trim the next adjacent second lumber piece.

The trimmer of the present invention includes a low profile housing which may be accessed for maintenance from the top of the housing by the opening of clam shell doors. The clam shell doors open oppositely so as to pivot about opposite perimeter edges of the top of the housing. The housing defines an upper compartment or cavity which may be closed by closing the clam shell doors. The upper compartment is bisected by a beam, which may be in the form of generally an I-beam. The beam bisects the compartment and runs parallel to perimeter edges about which the clam shell doors pivot.

The vertical webbing of the beam is apertured. The upper flanges of the beam mate with the distal ends of the clam shell doors when the doors are closed. The clam shell doors may be pivoted either manually or with the assistance of actuators known in the art. The floor of the cavity may be sheeted so as to provide a walkway for maintenance personnel. One or more of the clam shell doors may also be sheeted and shaped, so that when fully open, a further walkway is provided along the length of the trimmer housing.

A laterally spaced-apart array of drop saws are mounted along one half of the compartment, that is, on one side of the center beam. The drop saws are rotatably mounted on saw ladders which themselves are pivotally mounted to the beam web. The saw drive motors and the saw ladder actuator are mounted on the opposite side of the beam web, in the other half of the compartment. The actuator may be a cylinder which strokes through an aperture in the beam web so as to drive one end of a bellcrank-shaped saw ladder, the drop saws mounted at the opposite end of the bell crank. The drop saws may be each driven by a pair of drive belts, where the first drive belt extends between the saw hub and the pivoting hub of the saw ladder, and the second drive belt extends from the pivoting hub of the saw ladder to a drive shaft of a drive motor.

In one embodiment of the present invention, a single drive motor drives a pair of first drive belts where each of the pair of first drive belts drive oppositely disposed shafts extending through the pivot hubs of the saw ladders so as to thereby drive a pair of second drive belts, each of the second drive belts driving one of a pair of opposed facing drop saws.

In this arrangement, maintenance personnel merely have to open the clam shell doors and step down into and along the walkway for easy access to a malfunctioning drop saw drive belts or its associated actuator or actuating valves or motor or electronics or the like. Because the pair of second drive belts are most outwardly disposed on either side of the opposed facing pair of drop saws, maintenance tasks are eased by the ease of access to those drive belts. An eccentric surface on the saw ladder pivot tubes, to which the saw ladders are releasably rigidly mounted and which rotate within pivot housings mounted to the web of the beam, provides that releasing the rigid mounting of the saw ladder to the pivot tube allows rotation of the eccentric surface so as to thereby tension or detension the second drive belts. this allows easy removal or replacement of those drive belts. Servicing of the drop saw blades is also facilitated. The arrangement also maintains drive belt tension during pivoting of the saw arbors because the first and second drive belts rotate about a common shaft which is co-axial with the axis of rotation of the saw ladder. Again, because of ease of access, once the clam shell doors are open, into the compartment containing the drop saw drive and actuators, maintenance is thereby eased for those components. The use of a center beam to mount the saw arbors also eases the task of aligning the saws and adjusting the spacing between the saws. In particular, the pivot housings may be releasably mountable to the beam web, for example into a preformed or machined mating channel, so that the pivot housings may be adjusted relative to the length of the beam and secured thereto once desired spacing has been achieved. The clamping of the pivot housing to the beam web once the desired spacing has been achieved, thereby assists in attaining the alignment of the saws.

In summary then, in one aspect of the present invention a lumber trimming device is provided for trimming elongate workpieces conveyed on an infeed conveyor in a laterally disposed orientation relative to an infeed direction of the conveyor. The lumber trimming device operates in cooperation with an optimizer, and includes a gang of laterally spaced apart drop saws. The drop saws are independently actuable by actuating means according to trimming instructions from the optimizer. An end-trimming saw is mounted adjacent the gang. The end-trimming saw is selectively laterally translatable and in the preferred embodiment is only laterally translatable, that is, is not a drop saw or otherwise elevatable. Lateral translation is by selectively actuable translation means according to end-trimming instructions from the optimizer. The end-trimming saw thereby cooperates with the gang.

The end-trimming saw cooperates with the optimizer and the drop saws so that a first drop saw of the drop saws is actuated simultaneously with optimized lateral positioning of the end-trimming saw. Thus a first workpiece of the workpieces on the infeed conveyor is trimmed simultaneously by both the first drop saw in a first trim cut and the end-trimming saw in a second trim cut.

The end-trimming saw may be a first end-trimming saw which cooperates with the translation means and the optimizer to laterally re-position the first end-trimming saw subsequent to the second trim cut simultaneously with a second end-trimming saw mounted adjacent the gang actively laterally pre-positioning for an end trim cut on a second and next-adjacent workpiece on the infeed conveyor. The second end-trimming saw may, again, be only selectively laterally translatable the second end-trimming saw is translated by second translation means.

The second end-trimming saw may be mounted adjacent the first end-trimming saw. The first and second end-trimming saws may be mounted on a first side of, or in opposed facing relation on either side of, an infeed flow path of the workpieces passing into and through the gang. In the first instance the first and second end-trimming saws are in parallel alignment for parallel lateral translation during the lateral translation of the first and second end-trimming saws. In this embodiment the second end-trimming saw may be downstream of the gang and the first end-trimming saw may be generally laterally aligned with the drop saws. In the second instance, the first and second end-trimming saws are aligned for co-axial lateral translation during the lateral translation of the first and second end-trimming saws, and thus the first and second end-trimming saws are generally laterally aligned with the drop saws.

A further aspect of the invention includes workpiece clamping means for clamping a workpiece passing through the gang and downstream to the second end-trimming saw so as to prevent movement of the workpiece during the end trim by the second end-trimming saw.

The end trimming saws cooperate with the optimizer to default to lateral positions at a sub-optimal yield solution rather than positions for a trim solution optimized for yield if an optimized piece rate of the infeed must be reduced in order to effect said trim solution optimized for yield.

DETAILED DESCRIPTION OF EMBODIMENTS OF THE INVENTION

Figure 1:
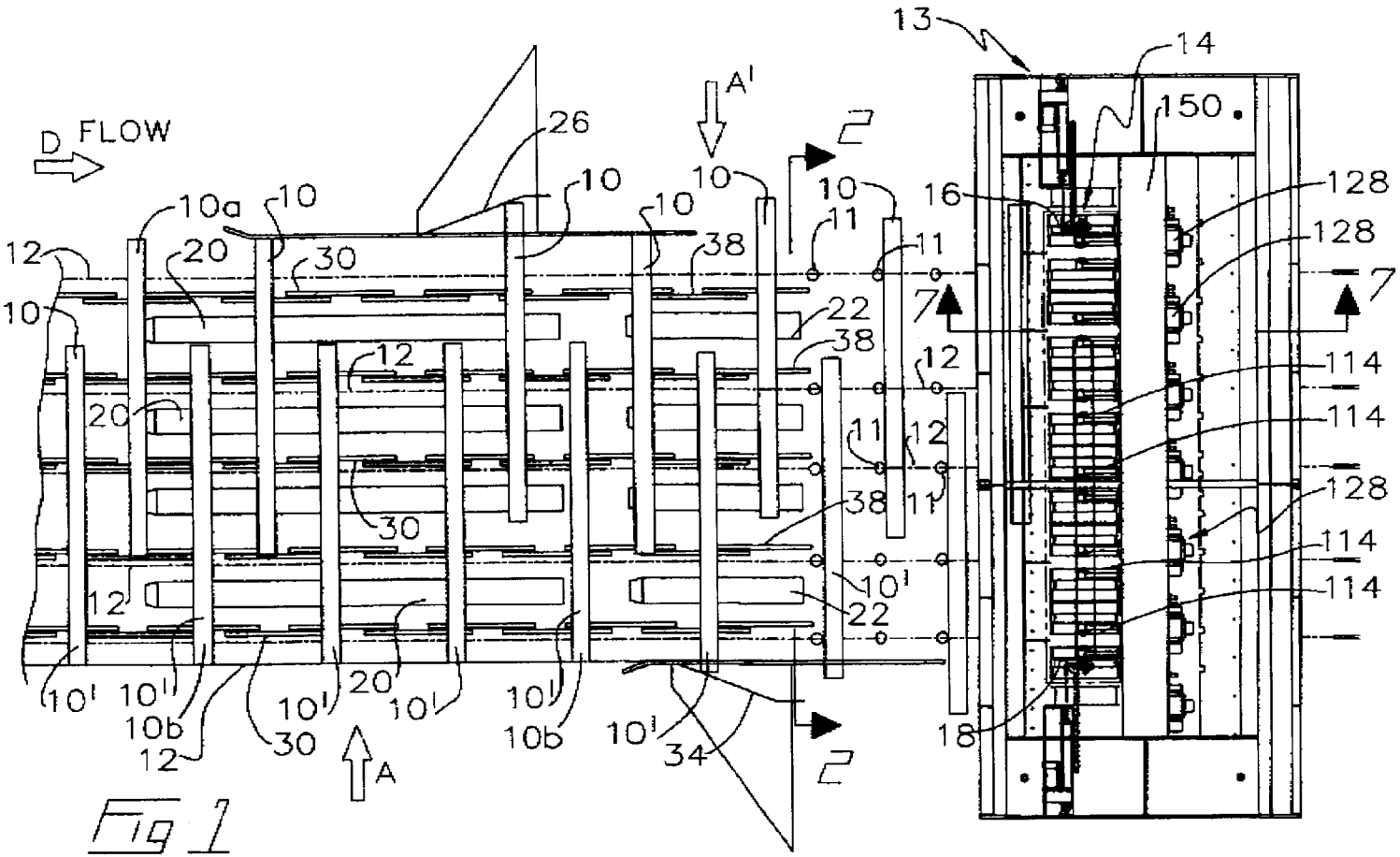
FIG. 1 is, in plan view, the lumber trimmer of the present invention cooperating with an infeed conveyor having a board positioning device upstream of the trimmer.
Figure 2A:
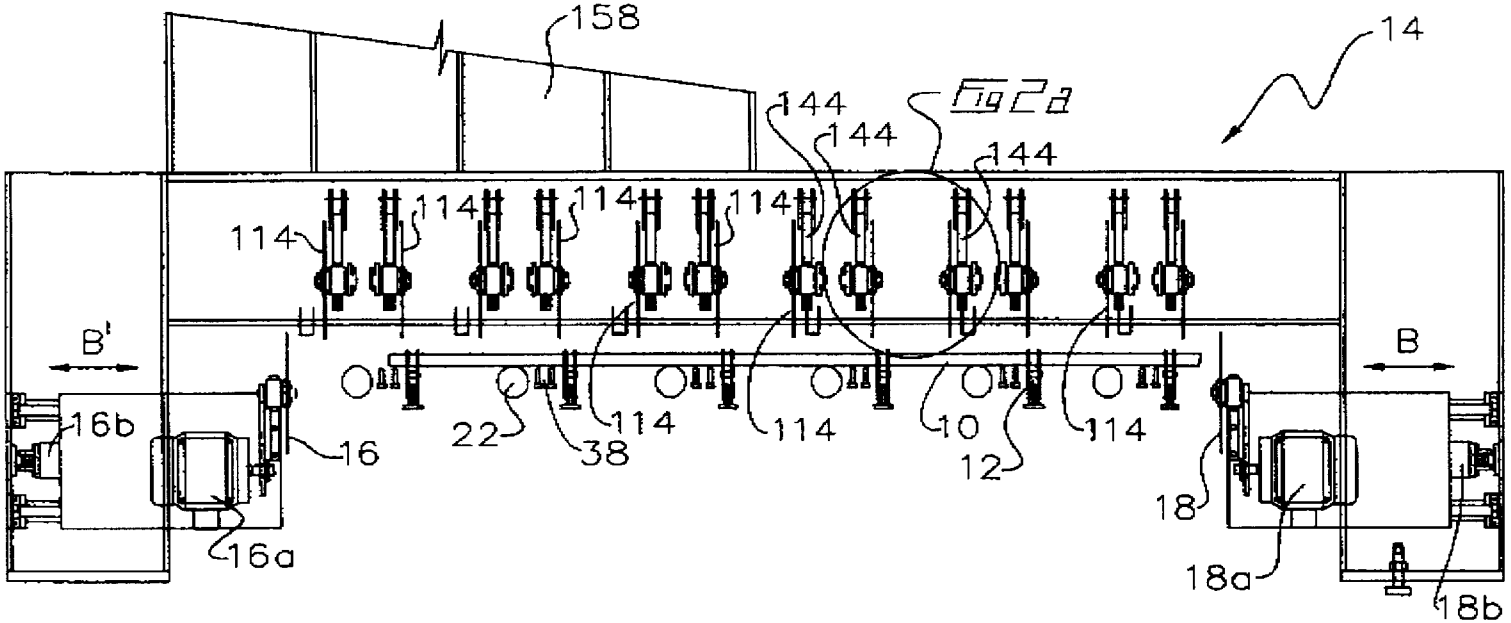
FIG. 2*a* is an enlarged partially cutaway view of a pair of drop saws of the trimmer of FIG. 2.

With reference to the drawing figures wherein similar characters of reference denote corresponding parts in each view, as seen in FIG. 1 boards 10 and 10' of various lengths, which may for example be generally between 8 to 10 feet, are conveyed in the direction indicated by the arrow labelled "Flow" by lugs 11 on chains 12. The boards on chains 12 are conveyed toward a trimmer 14 containing ganged trim saws 114. In one embodiment not intended to be limiting, the trimmer may include opposed facing end trim saws 16 and 18 better seen in FIG. 2. Saws 16 and 18 may be so-called precision end-trimming saws (P.E.T. saws) wherein the saw blades are driven by corresponding motors 16*a* and 18*a* and are selectively laterally translatable relative to drop saws 114 by means of selectively actuable actuators 16*b* and 18*b*.

An optimizer 24 (shown diagrammatically in dotted outline in FIG. 5) calculates an optimized trim solution for each board from scanner data for each board provided by an upstream scanner (not shown). As better seen in FIGS. 2 and 2*a*, the trimmer has a laterally spaced apart array of drop saws 114 which are fixed in their lateral spacing relative to one another. Optimizing the yield rate means implementing the optimal trimming solution as best as may be done by an array of fixed-position drop saws on, for example, one foot centers. Consequently, the use of a board positioner upstream of the trimmer allows positioning of the boards to use for example the two best positioned drop saws which best approximate the optimal trim solution to drop down to trim the board, or allows positioning the board to use a P.E.T. saw to trim one end, and a fixed position drop saw at the other end. Because the board may be laterally pre-positioned by the board positioner, whether it be by the board positioners described herein or by other board positioning means, the P.E.T. saw may also be pre-positioned in the time available (in one embodiment of the invention two lug spaces as better hereinafter described) to trim the first end of the board while the opposite second end of the board is trimmed by the optimal drop saw 114.

Chains 12 transport boards 10 over board positioners such as a first series of ending rolls 20 and a second series of ending rolls 22. First ending rolls 20 are rotatable, by selectively actuable drive means known in the art, and move boards 10 laterally on chains 12 in direction A. Movement of boards 10 in direction A is arrested when an end 10*a* of board 10 abuts up against a fence 26. Fence 26 may be fixed or active or may be left out entirely depending on the type of board positioner being employed. Lift skids 30, positioned between each of the first ending rolls 20, are remotely and selectively operable so as to elevate boards 10' which are alternative boards within the series of boards above ending rolls 20 to thereby prevent displacement of boards 10' toward fence 26.

The second series of ending rolls 22 are positioned downstream from the first series of ending rolls 20 and are rotatable so as to move boards 10' laterally on chains 12 in direction A', that is, opposite to direction A. Lateral movement of boards 10' in direction A' is again arrested when an end 10*b* of board 10' abuts against a fence 34 mounted opposite fence 26, for example offset from the zero line. Lift skids 38 are mounted between each of the second ending rolls 22 so as to elevate boards 10 within the series of alternating boards 10 and 10' sliding over rolls 22. Again, elevating the boards removes them from the urging of the ending rolls. Again, boards 10 are those which have been previously laterally displaced in direction A by the action of first ending rolls 20.

Thus, end trim saws 16 and 18, in combination with ending rolls 20 and 22 and lift skids 30 and 38, may as needed (i.e. when the optimizer determines a P.E.T. sawing is desirable) alternatingly only trim every second board in the series of boards that are on the board conveyor. This effectively increases the length of allowable time for reciprocal adjustment of each of the end trim saws, i.e. from one lug space to two lug spaces. Consequently the piece rate may be maintained while still implementing an optimized trim solution or a slightly sub-optimized trim solution so as to not substantially affect the yield rate.

Figure 3:
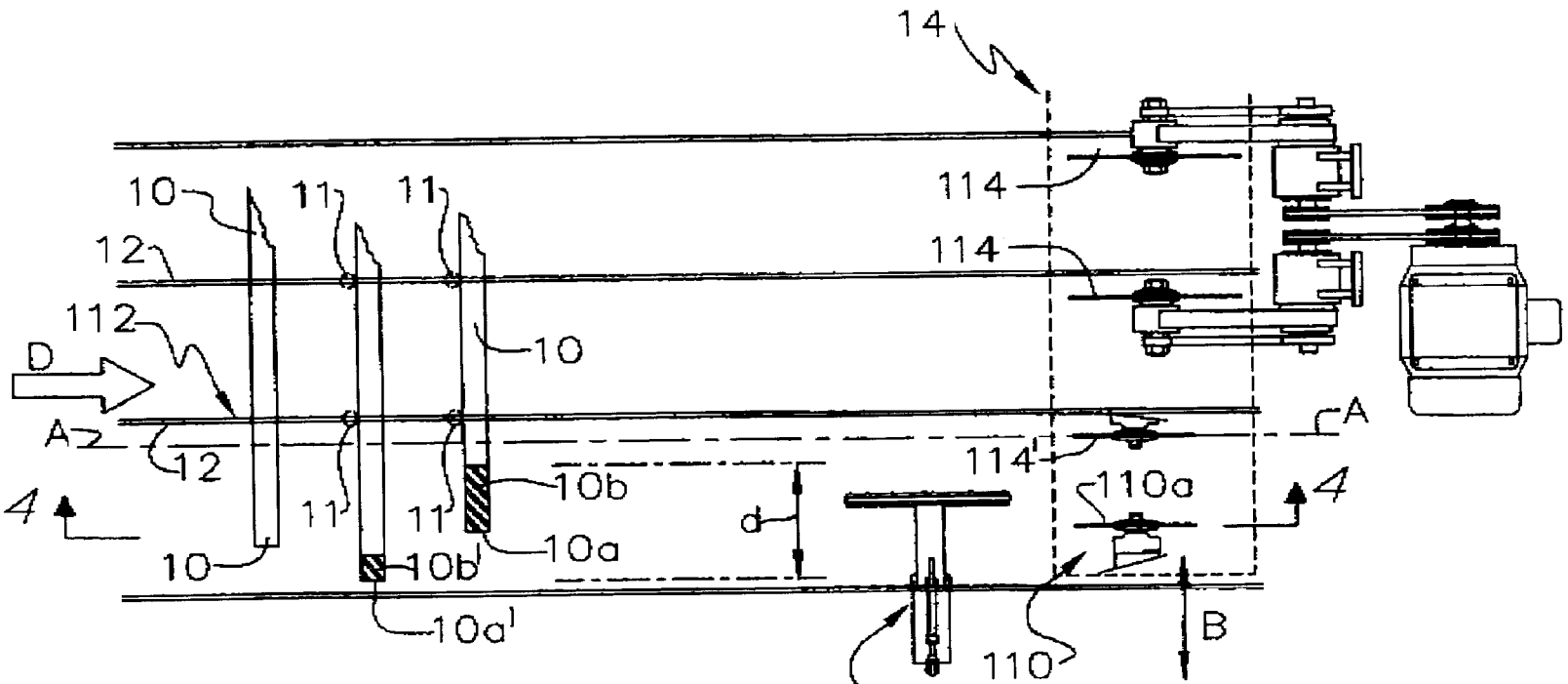
FIG. 3 is, in partially cutaway plan view, a further embodiment of the lumber trimmer of the present invention.
Figure 4:
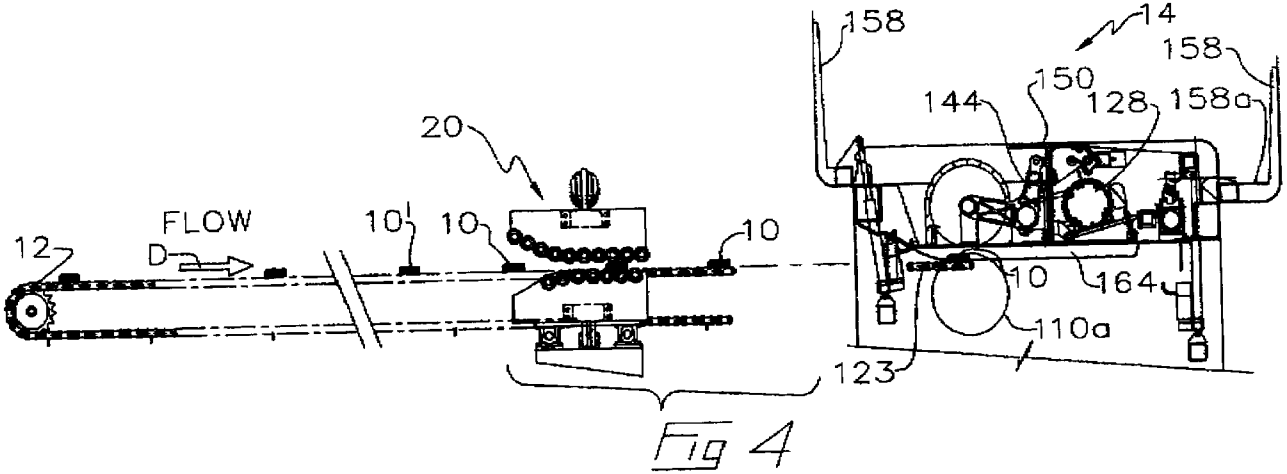
FIG. 4 is in partially cutaway side elevation view, the embodiment of FIG. 3.

FIGS. 3 and 4 illustrate the use of single P.E.T. saw 110 in line with drop saws 114. Drop saws 114 include zero line drop saw 114' along the lumber line or zero line A—A in trimmer 14.

Figure 2D:
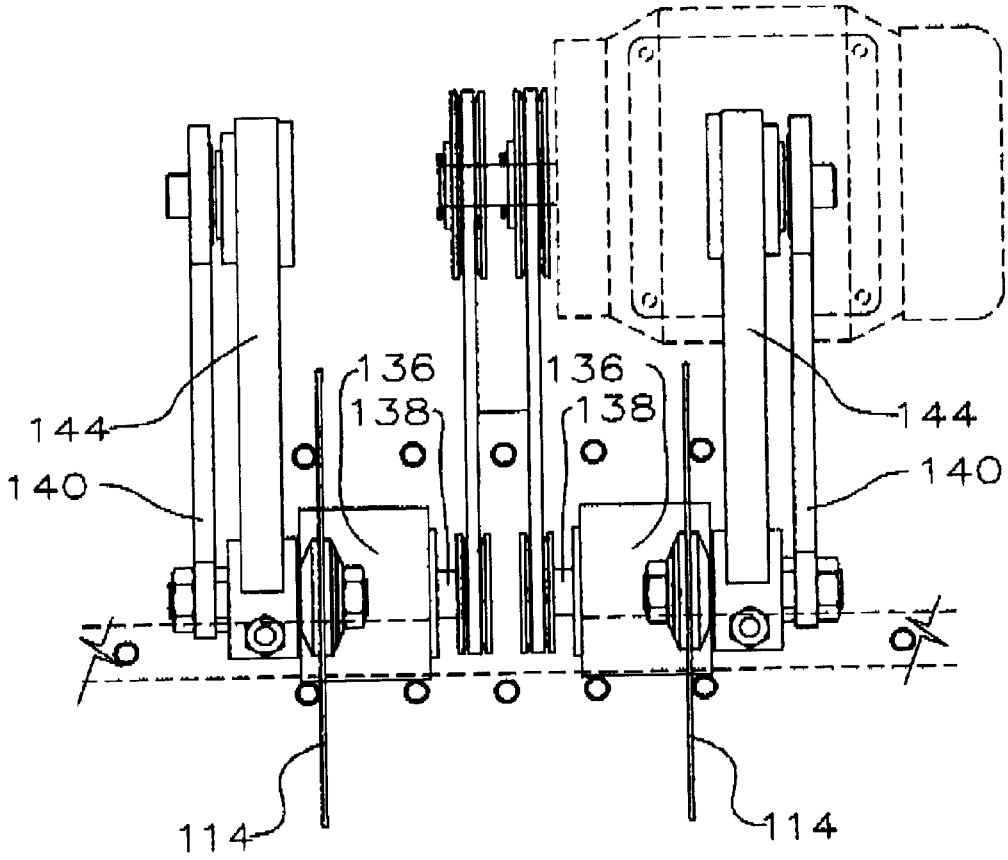
FIG. 2 is a sectional view along line 2—2 in FIG. 1.

P.E.T. saw 110 includes a motor and drive arrangement such as seen in FIG. 2 and a circular saw blade 110*a*. P.E.T. saw 10 is actuable by actuator such as seen in FIG. 2 so as to be slidable transversely in direction C perpendicular to the infeed direction D of boards 10 on the infeed conveyor 112.

Figure 5:
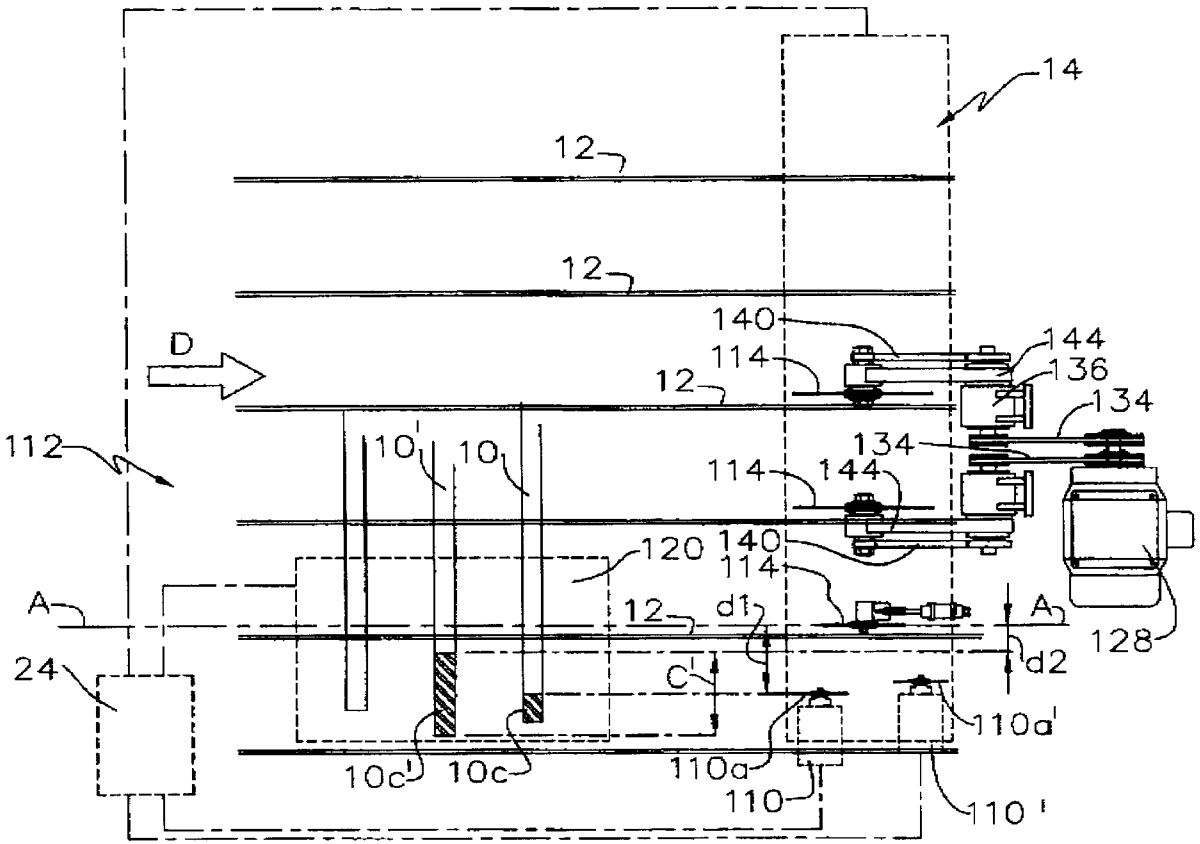
FIG. 5 is, in partially cutaway plan view, the further embodiment of the lumber trimmer of the present invention.
Figure 7:
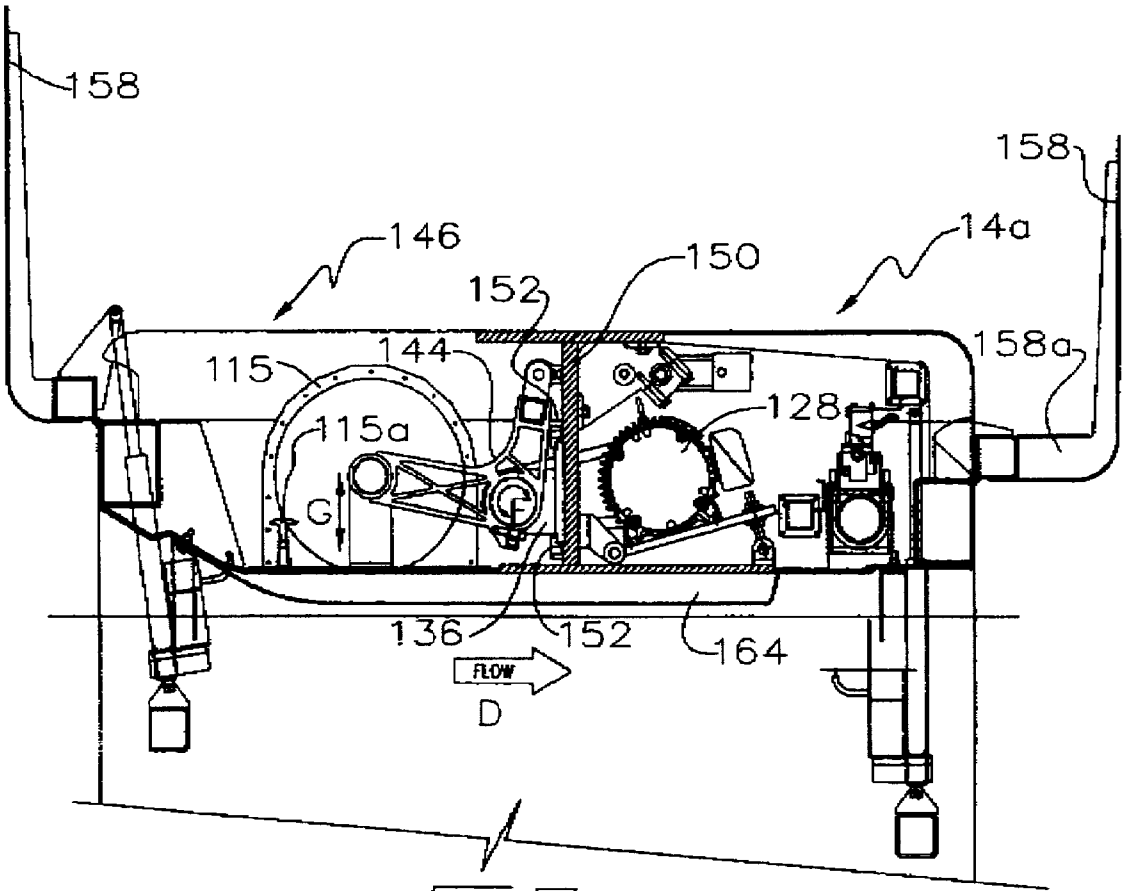
FIG. 7 is, in enlarged side elevation view, the trimmer of FIG. 4.
Figure 8:
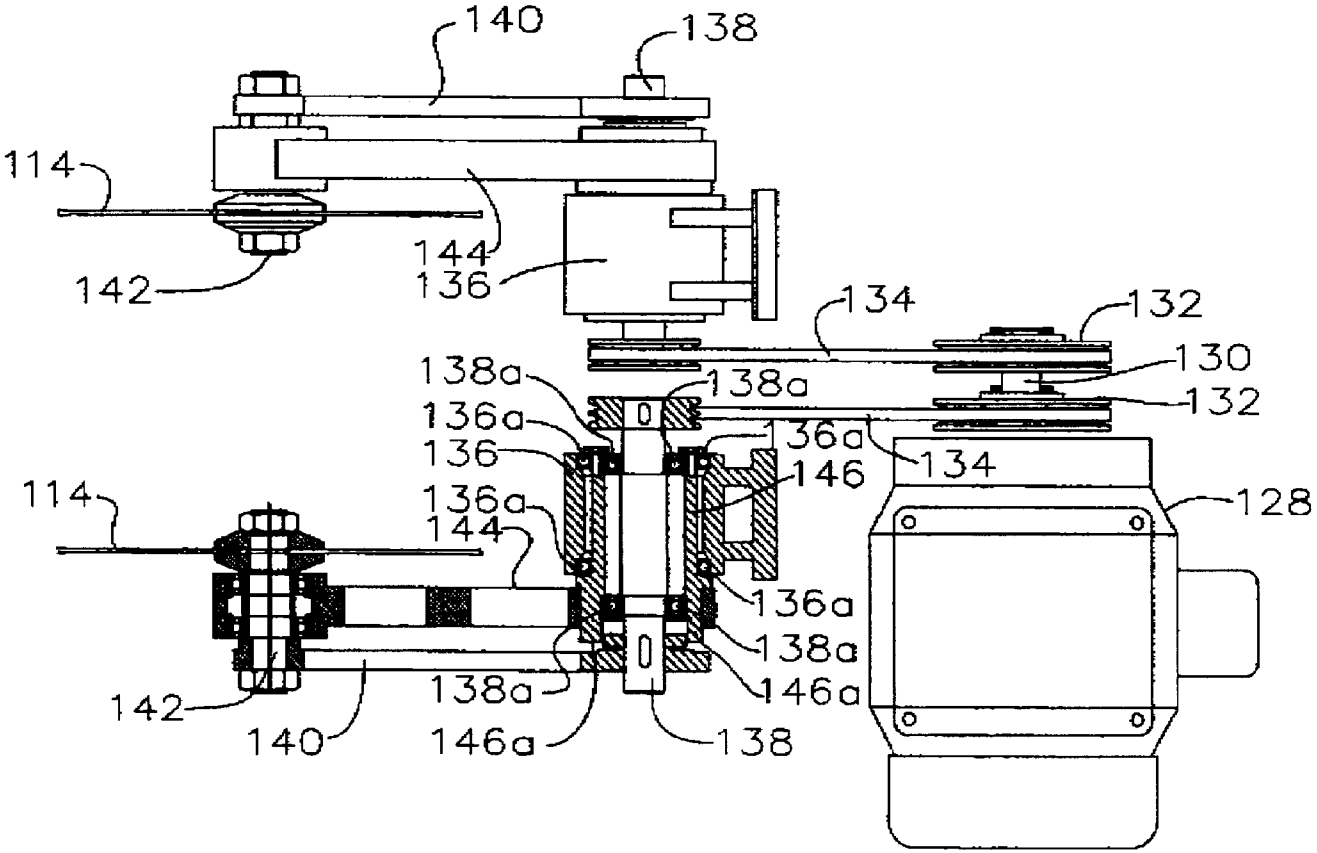
FIG. 8 is, in enlarged partially sectioned view, the drop saws of FIG. 2*a* and their associated drive mechanism.
Figure 9:
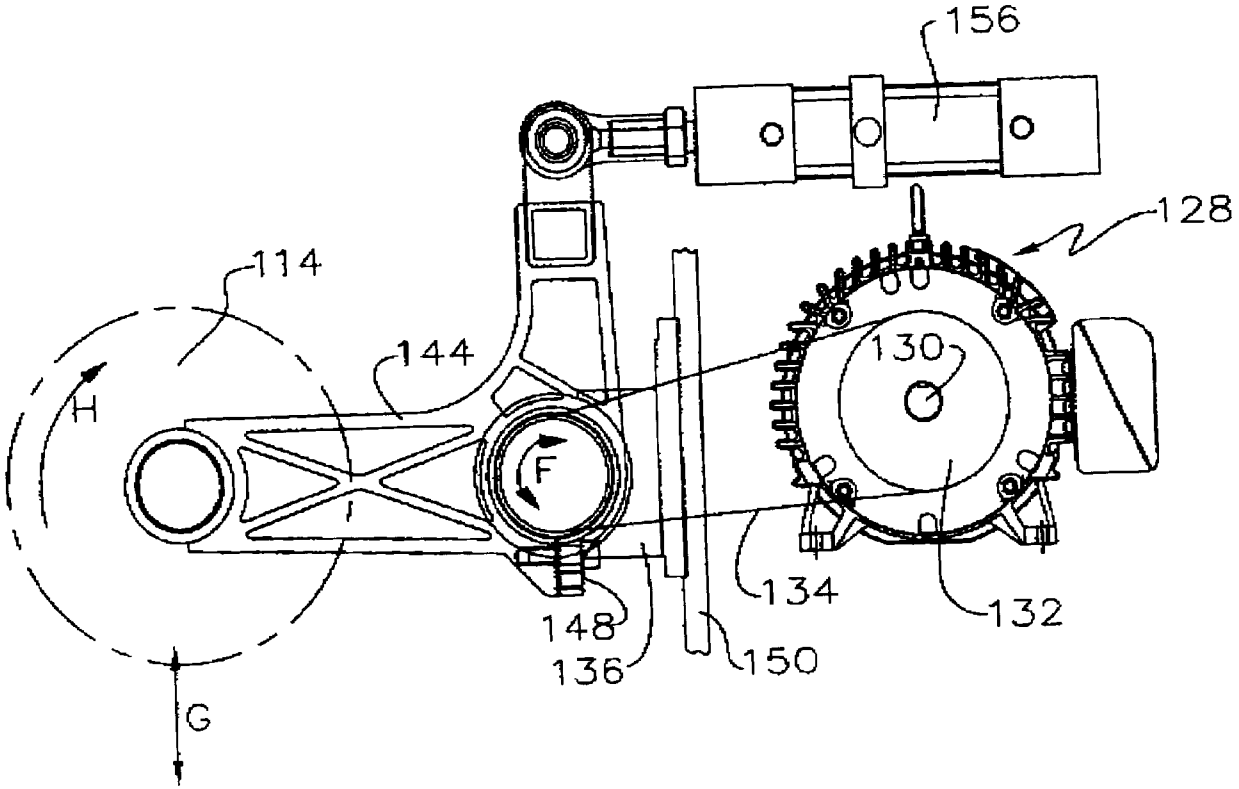
FIG. 9 is, in partially cutaway side elevation view, the drop saws and drive mechanism of FIG. 8 and its actuator mechanism.
Figure 10:
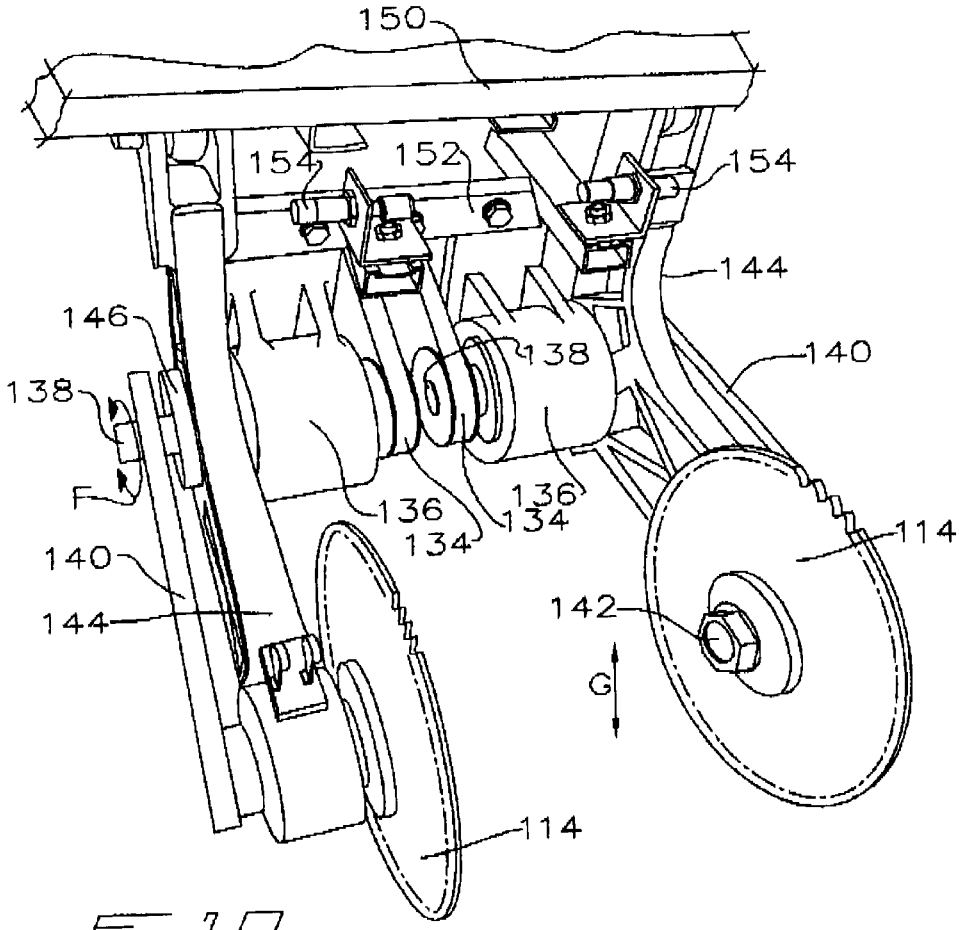
FIG. 10 is, in partially cutaway perspective view, the drops saws of FIG. 8 installed in the trimmer of FIG. 7.
Figure 11:
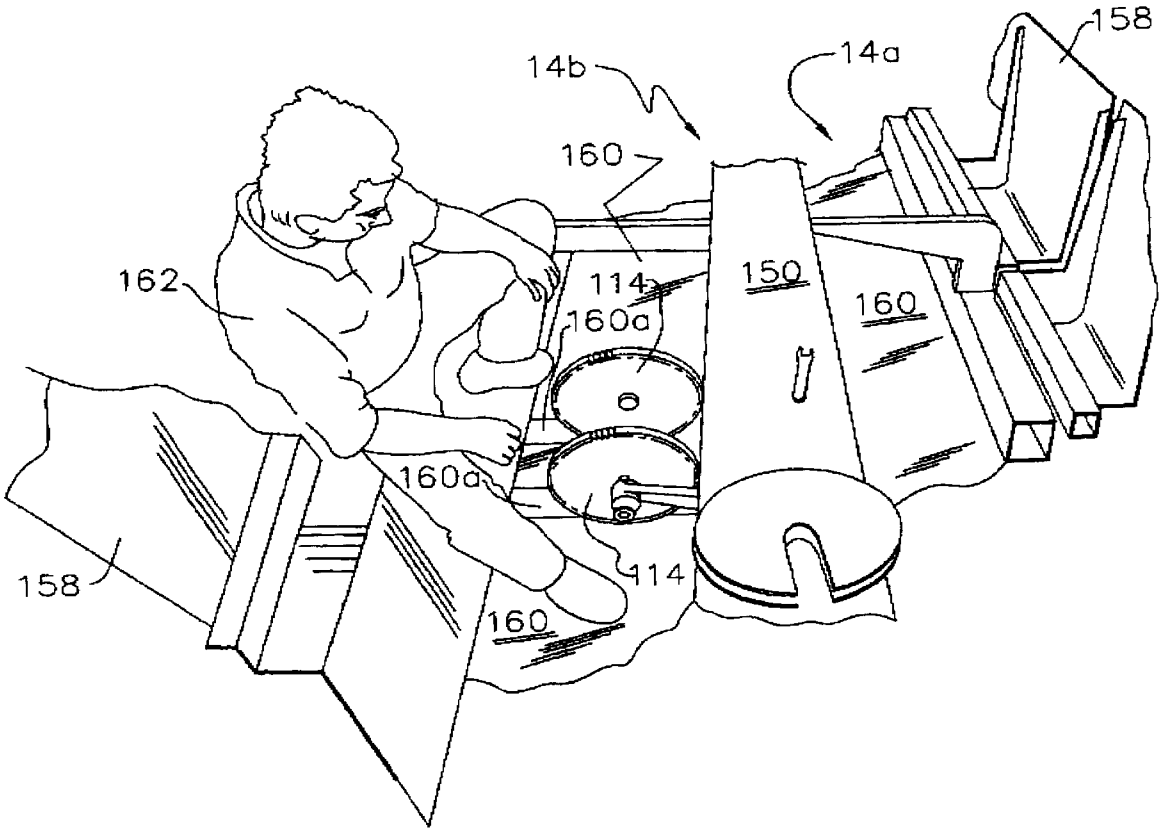
FIG. 11 is, in partially cutaway top perspective view, the trimmer of FIG. 7 during maintenance work.

Boards 10 may be actively ended or otherwise actively positioned by board ending positioners known in the art such as the active board ending positioner 20 illustrated and generally indicated diagrammatically in FIG. 5 within the dotted outlined area 120. Boards 10 thus may have their ends 10*a* selectively positioned within a preset desired range "d" of zero line A—A, where range "d" may be in the order of 12 inches. Thus, where P.E.T. saw 110 is actively positionable in direction C, P.E.T. saw blade 110*a* may be actively positioned to trim for example a first end block 10*b* close to the zero line on board 10, and then may be required to only trim a small end block 10*b'* adjacent end 10*a'* of board 10' so that within one lug spacing between lugs 11 on transfer chains 12, blade 110*a* must translate a substantial portion of range dimension "d". If in fact the optimizer determines that it is not physically possible to translate blade 110*a* by that distance without slowing down the transfer rate of the conveyor, the optimizer may default to lesser value cutting solutions in one or both of boards 10 and 10' so as to reduce the distance within range dimension "d" that blade 110*a* has to travel within one lug space.

Alternatively, as seen in FIG. 5 a second P.E.T. saw 110' may be mounted either in an upstream or pre-trim position or in a downstream or post-trim position relative to P.E.T. saw 110. P.E.T. saw 110' may be also actively transversely positioned along the axis of rotation of its circular saw blade 110*a'* so as to slide transversely in direction C' parallel to P.E.T. saw 110 sliding transversely in direction C. In this arrangement, a first board, for example board 10 entering into the trimmer may be actively positioned by a board positioner 120 to optimize the trimming solution for the board. The optimizer, shown diagrammatically in dotted out-line and indicated by reference numeral 24, allocates the end trimming of board 10 to P.E.T. saw 110 which prepositions itself in this example to be distance d, from zero line A—A to trim block 10*c* and then retracts away from the zero line as P.E.T. saw 110' is positioning its blade 110*a'* so as to end trim block 10*c'* from board 10'. The trimming of block 10*c'* requires blade 110*a'* to be positioned a distance $d_2$ from the zero line.

It may be that in some instances P.E.T. saw 110 cannot in the time between the single chain lug spacing pull completely out of the way of the incoming board heading to be end trimmed by the second P.E.T. saw 110'. In such an instance the optimizer, rather than slowing down the conveyor, will allow P.E.T. saw 110 (that is, the upstream P.E.T. saw) to saw off a junk block so as to remove part of the end block (for example part of block 10*c'*) which the second or downstream P.E.T. saw 110' is responsible for trimming off. As with the single P.E.T. saw embodiment, the optimizer may also default to lesser value trimming solutions rather than slow the conveyor so as to maintain the piece rate while only slightly adversely affecting the yield rate. In this fashion, P.E.T. saws 110 and 110', i.e. which merely translate laterally, may be employed rather than having to use shifting flying drop saws which, not only introduce complexity but also delay while accommodating for both elevating and dropping the saws as well as laterally translating the saws.

Figure 6:
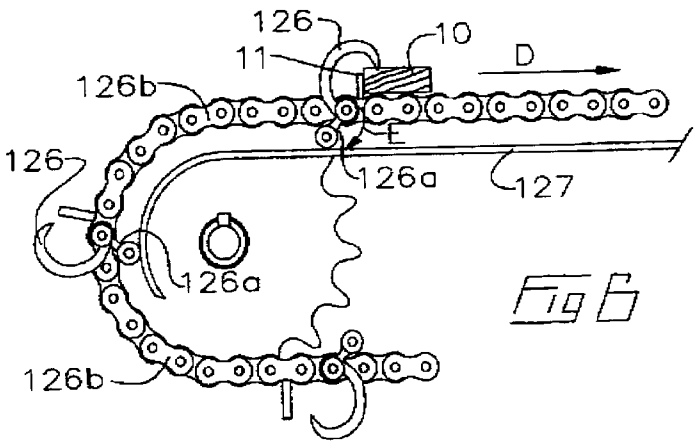
FIG. 6 is, in partially cutaway side elevation view, a board stabilizer for stabilizing a board for P.E.T. sawing.

Because conventionally it is desired to maintain two saws in contact with a board during trimming so that at all times there are two saws in the cut, it may be with the use of a second P.E.T. saw 110' that it may not always be possible to have two saws in the cut, in which case it may be desirable to employ a board stabilizer such as actuable hooks 126 such as seen in FIG. 6 or a restraining device such as a board grabber adjacent chain runs 23. Hooks 126 have trailing arms 126*a* which ride on a guide bar 127 as the hooks circulate to the top side of their own circulating chain 126*b*. The hooks are pivotally mounted on chain 126*b*. The guide bar acts on the arms so that the arms pivot and rotate the hooks in direction E into engagement with boards 10. When circulating along the underside of chain 126*b*, the hooks may hang free.

As better illustrated in the remainder of the views, FIGS. 7–11, saws 114 are driven in pairs by a single motor 128. A standard 1800 rpm motor having a single shaft 130 out of one end is employed. Two sheaves 132 are locked on shaft 130 with bikon hubs so that the sheaves can be moved independent of each other for fine saw-spacing alignment. Sheaves 132 drive belts 134 down to an opposed facing pair of jack shaft/pivot housings 136. Housings 136 are assembled in mirror image and mounted to the trimmer frame so that sheaves 132 may be side-by-side and the saws 114 remain at the desired (e.g. 1 foot) saw spacing. Jack shafts 138 drive belts 140 down to saw arbor shafts 142 parallel to saw ladders 144. Shafts 142 are mounted through the distal ends of the saw ladders. This jack shaft arrangement allows the use of a standard 1800 rpm motor and still get approximately 5120 rpm in direction H at the saw blades. It also allows the changing of any of the belts with only loosening belt tension. This reduces maintenance time. The saw ladders 144 are clamped onto pivot tubes 146. Pivot tubes 146 each have an eccentric surface machined into them so the belts from the jack shaft to the saw arbor can be tensioned by loosening the saw ladder clamp 148 and rotating the eccentric pivot housing. The eccentric surface 146*a* is seen in cross section in FIG. 8. The saw ladder has high speed arbor bearings that can be changed without having to remove the pivot assembly. That is, maintenance personnel do not have to do a realignment when changing the saw ladder and arbor bearings. In a further embodiment, a single double shafted 1800 rpm motor may be employed to drive four saws with one motor.

The trimmer may be described as a low-profile trimmer and include a fabricated center support beam 150. The pivot housings are mounted to the beam so as to eliminate most of the alignment required during assembly. In particular, the pivot housings sit in a machined grove in the beam. Clamps 152 clamp the pivot housings to the beam. They allow housings 136 to be slid sideways and clamped to the beam for desired saw spacing. The lead and level of the saws do not require adjusting because a machined surface is used to mount the pivot housing 136.

The pivot bearings 136*a* for the saw ladders 144 are not the same bearings that are used for jack shaft 138. Using different bearings allows us the use of smaller bearings 138*a* on the jack shafts to accommodate the high rpm of the jack shaft and larger bearing on the saw ladder pivot housing to accommodate the mass and impact of the saw ladder. This also allows the use of the eccentric tensioning on the arbor belts 140.

The saw ladders 144 are selectively rotatable in direction F about the pivot tubes so as to raise and lower saws 114 in direction G upon actuation of actuators or cylinders 156. Proximity switches 154 monitor the saw ladder movement. They are provided one for the upper or raised position of the saws and one for the lowered position of the saws. This allows determining if there has been a catastrophic failure of the actuator cylinder 156 or the cylinder valve so that the equipment may be stopped immediately. The performance of the cylinder and valve may also be determined by monitoring the time it takes to move from one position to the other. If this time becomes slower that a desired pre-set value an alarm may be activated so that the faulty parts may be repaired or replaced before the performance of the trimmer is affected.

Trimmer 14 is divided into two halves 14*a* and 14*b*. The pneumatic and electrical components are mounted on side 14*a* and the saws 114 are mounted on the other side 14*b*. A small blower is used to pressurize the two halves of the trimmer when the clamshell doors 158 are closed so as to lie flush against the top of beam 150. The air first flows into the more sensitive side 14*a* (electrical and pneumatic components) and then flows through openings in beam 150 to the less sensitive side 14*b* (saws). The air then flows through the saw openings 160*a* in walkway sheeting 160 to the waste conveyor area below. The waste conveyor area has negative pressure via the mills dust collection system. This is intended to keep the most sensitive area the cleanest and reduce the sawdust build up inside the trimmer. Saw covers 115 may be mounted over saws 114 and are secured to the walkway or cross beams by latches 115*a*.

When doors 158 are open they act as railings for maintenance people 162 in the trimmer. One set of doors may have sheeting 158*a* on the inside of the door so that it may be used as a walkway when the doors are open.

Hold down shoes 164 may be constructed using 1/8"×1.5" spring steel. The mass of the hold down shoe is not used to apply force down onto the board. The hold down shoes utilize the stiffness of the steel to apply force down onto the boards. This means that there is no pivot required so there are fewer pieces. The flexibility of the spring steel also allows the applying of force down on more than one board at a time. This allows the use of the hold down shoe to hold the boards down while the boards are cut and at the same time allows application of a force on the already cut trim block to help knock it down into the waste conveyor.

The P.E.T. saw or saws 110 and their drives are located below the flow of the boards on chains 23 while drop saws 114 are located above the flow. This provides the ability to have each P.E.T. saw travel past the 0' saw (eg saw 114') so that P.E.T. lengths may be cut inside the lumber line. Because the trimmer frame is not handed, the capability is provided to have a P.E.T. saw at both the lumber line and the opposite clear line of the trimmer.

The trimmer line speed during P.E.T. sawing has in the past been determined by the worst case scenario. It has been assumed the P.E.T. saw has to travel into the furthest stroke, saw the board off, and then retract while running the widest pieces. It is different in planermills where the mill is only running one width piece at a time. For example, you may have to run slower on 2×10's than you do on 2×4's.

As described above, the fencing or board positioner information coming from the optimizer may be used to pre-position the P.E.T. saw or to move the P.E.T. saw to the desired location in steps during the previous boards. If we have for example four boards in a row, the third board requires a −3" P.E.T. decision. Because the first two boards are being cut by the 0' saw the P.E.T. saw can move into position in steps while the first two boards go by. If by chance the one of first two boards has a 12" fence position then the P.E.T. saw would possibly cut into two the trim block of that piece. If you have two P.E.T. sawing decisions in a row that require more movement than the P.E.T. saw can do, the optimizer decisions for the two boards are reviewed. The second or third best decision may be chosen for either of the boards and avoid the problem of having two P.E.T. decisions in a row that it may not be possible to handle. This may reduce the value of the board that is cut by a small amount but if the system does not have to be slowed down so as to loose production, this may be a better overall solution for the mill.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. For operation in cooperation with an optimizer, a lumber trimming device for trimming ends of elongate workpieces conveyed on an infeed conveyor, the workpieces in a laterally disposed orientation relative to an infeed direction of the conveyor, said lumber trimming device comprising:

a gang of laterally spaced apart drop saws wherein said drop saws are independently actuable by actuating means according to trimming instructions from the optimizer, first and second end-trimming saws mounted adjacent said gang, said end-trimming saws selectively laterally translatable by selectively actuable translation means according to end-trimming instructions from the optimizer, said end-trimming saws thereby cooperating with said gang, wherein said first end-trimming saw cooperates with the optimizer and said drop saws so that a first drop saw of said drop saws is actuated simultaneously with optimized lateral positioning of said first end-trimming saw so as to trim a first workpiece of the workpieces on the infeed conveyor simultaneously by both said first drop saw in a first trim cut and said first end-trimming saw in a second trim cut, said first end-trimming saw cooperating with said translation means and the optimizer to laterally re-position said first end-trimming saw subsequent to said second trim cut simultaneously with said second end-trimming saw actively laterally pre-positioning for an end trim cut on a second and next-adjacent workpiece on the infeed conveyor, wherein said end-trimming saws only translate horizontally laterally and do not raise and lower, whereby the time required to position said end-trimming saws to cut the workpieces is minimized, and wherein lateral positioning means upstream of said end-trimming saws and said gang cooperatively position the workpieces according to instructions from the optimizer for optimized trimming, and wherein no lateral positioning of the workpieces occurs between said end-trimming saws and said gang.

2. The device of claim 1 wherein said second end-trimming saw is mounted adjacent said first end-trimming saw, wherein both said first and second end-trimming saws are mounted on a first side of an infeed flow path of said workpieces passing into and through said gang.

3. The device of claim 2 wherein said first and second end-trimming saws are in parallel alignment for parallel lateral translation during said lateral translation of said first and second end-trimming saws.

4. The device of claim 3 wherein said second end-trimming saw is downstream of said gang and said first end-trimming saw is generally laterally aligned with said drop saws.

5. The device of claim 4 further comprising workpiece clamping means for clamping a workpiece passing through said gang and downstream to said second end-trimming saw so as to prevent movement of the workpiece dining said end trim by said second end-trimming saw.

6. The device of claim 1 wherein said second end-trimming saw is mounted in opposed facing relation to said first end-trimming saw so that said first and second end-trimming saws are mounted on opposite sides of an infeed flow path of said workpieces passing into and through said gang.

7. The device of claim 6 wherein said first and second end-trimming saws are aligned for co-axial lateral translation during said lateral translation of said first and second end-trimming saws.

8. The device of claim 7 wherein said first and second end-trimming saws are generally laterally aligned with said drop saws.

9. For operation in cooperation with an optimizer, a lumber trimming device for trimming ends of elongate workpieces conveyed on an infeed conveyor in a laterally disposed orientation relative to an infeed direction of the conveyor, said lumber trimming device comprising:

a gang of laterally spaced apart drop saws wherein said drop saws are independently actuable by actuating means according to trimming instructions from the optimizer, an end-trimming saw mounted adjacent said gang, said end-trimming saw only selectively laterally translatable by selectively actuable translation means according to end-trimming instructions from said optimizer, said end-trimming saw thereby cooperating with said gang, wherein said end-trimming saw cooperates with the optimizer and said drop saws so that a first drop saw of said drop saws is actuated simultaneously with optimized lateral positioning of said end-trimming saw so as to trim a first workpiece of the workpieces on the infeed conveyor simultaneously by both said first drop saw in a first trim cut and said end-trimming saw in a second trim cut, wherein said end-trimming saw only translates horizontally laterally and does not raise and lower, whereby the time required to position said end-trimming saw to cut the workpieces is minimized, wherein lateral positioning means upstream of said end-trimming saw and said gang cooperatively position the workpieces according to instructions from the optimizer for optimized trimming, and wherein no lateral positioning of the workpieces occurs between said end-trimming saw and said gang.

10. The device of claim 9 wherein said end-trimming saw is a first end-trimming saw, and wherein said first end-trimming saw cooperates with said translation means and the optimizer to laterally re-position said first end-trimming saw subsequent to said second trim cut simultaneously with a second end-trimming saw mounted adjacent said gang actively laterally pre-positioning for an end trim cut on a second and next-adjacent workpiece on the infeed conveyor, said second end-trimming saw only selectively laterally translatable by second translation means.

11. The device of claim 10 wherein said second end-trimming saw is mounted adjacent said first end-trimming saw, wherein both said first and second end-trimming saws are mounted on a first side of an infeed flow path of said workpieces passing into and through said gang.

12. The device of claim 11 wherein said first and second end-trimming saws are in parallel alignment for parallel lateral translation during said lateral translation of said first and second end-trimming saws.

13. The device of claim 12 wherein said second end-trimming saw is downstream of said gang and said first end-trimming saw is generally laterally aligned with said drop saws.

14. The device of claim 13 further comprising workpiece clamping means for clamping a workpiece passing through said gang and downstream to said second end-trimming saw so as to prevent movement of the workpiece during said end trim by said second end-trimming saw.

15. The device of claim 10 wherein said second end-trimming saw is mounted in opposed facing relation to said first end-trimming saw so that said first and second end-trimming saws are mounted on opposite sides of an infeed flow path of said workpieces passing into and through said gang.

16. The device of claim 15 wherein said first and second end-trimming saws are aligned for co-axial lateral translation during said lateral translation of said first and second end-trimming saws.

17. The device of claim 16 wherein said first and second end-trimming saws are generally laterally aligned with said drop saws.

* * * * *